US008365886B2

(12) United States Patent
Mehta

(10) Patent No.: US 8,365,886 B2
(45) Date of Patent: Feb. 5, 2013

(54) FOLDABLE AND/OR DISPOSABLE LUGGAGE

(76) Inventor: Vinay K. Mehta, Maharashtra (IN)

( * ) Notice: Subject to any disclaimer, the term of this patent is extended or adjusted under 35 U.S.C. 154(b) by 273 days.

(21) Appl. No.: 12/450,318

(22) PCT Filed: Mar. 18, 2008

(86) PCT No.: PCT/IN2008/000164

§ 371 (c)(1), (2), (4) Date: Mar. 8, 2010

(87) PCT Pub. No.: WO2009/027992

PCT Pub. Date: Mar. 5, 2009

(65) Prior Publication Data

US 2010/0193312 A1 Aug. 5, 2010

(30) Foreign Application Priority Data

Mar. 22, 2007 (IN) ..... 536/MUM/2007

(51) Int. Cl.
*A45C 5/14* (2006.01)
*A45C 7/00* (2006.01)
*A45C 13/00* (2006.01)

(52) U.S. Cl. ..... 190/18 A; 190/107; 280/37

(58) Field of Classification Search ..... 190/103–107, 190/18 A; 229/117.01, 117.14, 116.4, 164, 229/199, 942; 280/37, 47, 26, 639, DIG. 3; 220/4, 6

See application file for complete search history.

(56) References Cited

U.S. PATENT DOCUMENTS

| | | | | | |
|---|---|---|---|---|---|
| 670,612 | A | * | 3/1901 | Houghland | 229/122.34 |
| 1,123,289 | A | * | 1/1915 | Helweg | 229/125.28 |
| 1,501,134 | A | * | 7/1924 | Osburn | 229/117.14 |
| 1,747,980 | A | * | 2/1930 | Kondolf | 229/117.06 |
| 2,555,718 | A | * | 6/1951 | Vinesberg | 190/107 |
| 2,639,082 | A | * | 5/1953 | Goldsmith | 229/117.24 |
| 2,645,407 | A | * | 7/1953 | Bergstein | 229/117.24 |
| 2,716,558 | A | * | 8/1955 | Sullivan | 280/651 |
| 2,868,557 | A | * | 1/1959 | Klipp et al. | 280/47.131 |
| 3,294,307 | A | * | 12/1966 | Munroe | 206/600 |
| 4,160,496 | A | * | 7/1979 | Knight | 190/107 |
| 4,318,505 | A | * | 3/1982 | Cordell, Jr. | 190/115 |
| 6,039,243 | A | * | 3/2000 | Lickton | 229/117.01 |

FOREIGN PATENT DOCUMENTS

| | | | |
|---|---|---|---|
| EP | 1375362 | A | 1/2004 |
| GB | 2346078 | A | 8/2000 |

* cited by examiner

*Primary Examiner* — Sue Weaver

(57) ABSTRACT

The present invention provides a luggage, which is mainly foldable and/or disposable. In preferable terms, the present invention provides said foldable and/or disposable luggage made of corrugated board having wheels adapted detachably to the luggage, which makes the luggage easy to handle, store and stackable. Said foldable and/or disposable luggage comprises two main panels, namely top main panel and a bottom main panel, and a plurality of side panels of the luggage formed by folding at least one scored die-cut flat blank, an extended panel, and a ply having wheels aligning with the holes of the said panel.

18 Claims, 9 Drawing Sheets

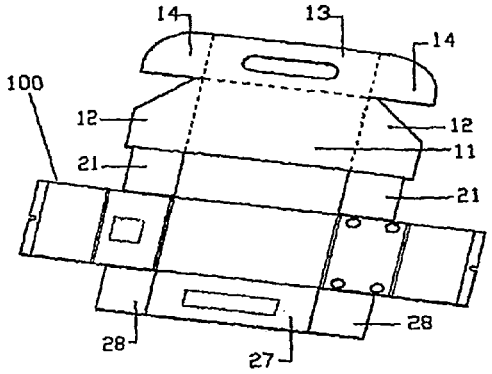
Fig. 2B
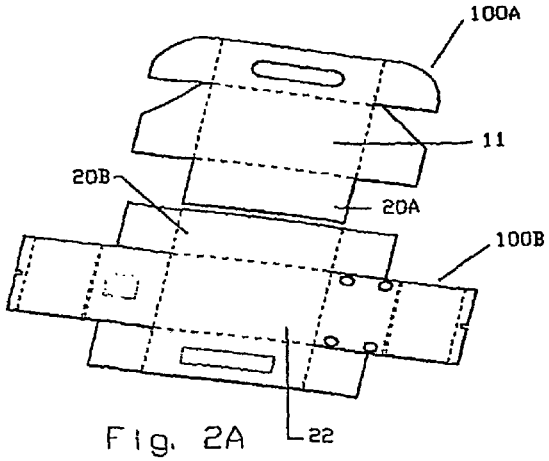
Fig. 2A
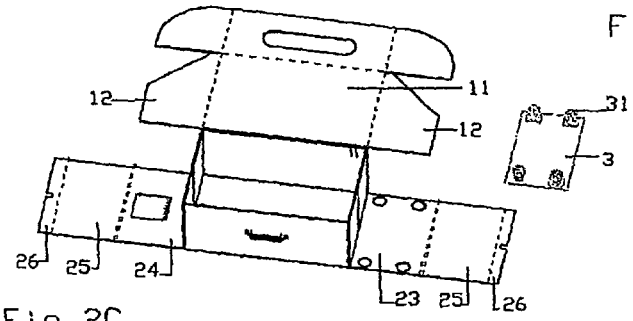
Fig. 2C
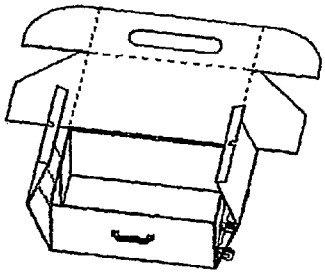
Fig. 2D
Fig. 2

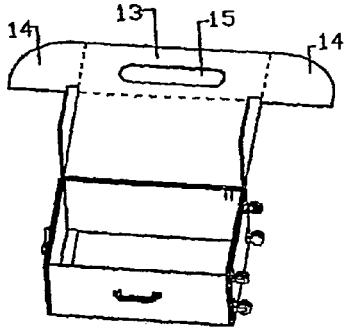
Fig. 2E
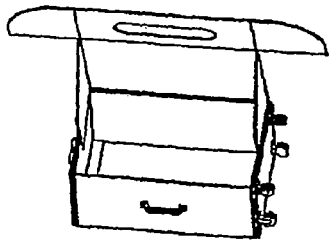
Fig. 2F
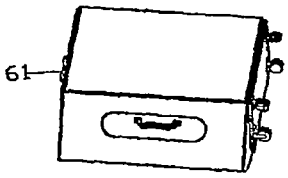
Fig. 2G
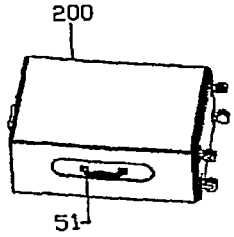
Fig. 2H
Fig. 2

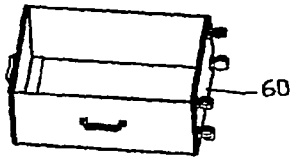
Fig. 4D'
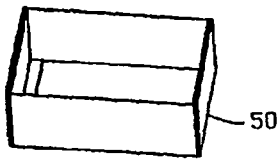
Fig. 4D
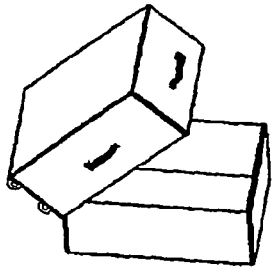
Fig. 4E
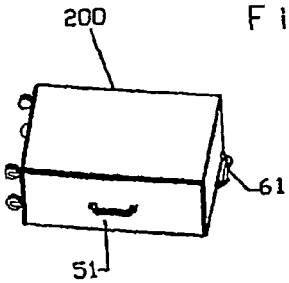
Fig. 4F
Fig 4

FOLDABLE AND/OR DISPOSABLE LUGGAGE

FIELD OF THE INVENTION

The present invention relates to a luggage and particularly to a foldable and/or disposable luggage, which is easy to handle.

BACKGROUND ART

Luggage is the standard means designed to carry items from place to place. The carrying capacity of a luggage is depends upon the interior volume of the luggage and strength of the luggage. Presently available travel suitcases/luggage are generally made by molding plastics or made from metal or fabrics.

Now a day, traveling is increased for business purpose, study tours, tourism etc. Some time, Travelers may require buying an expensive luggage or suitcase unnecessarily on his return journey due to increase in the luggage or sometime traveler has to carry an empty luggage on his return journey. Naturally no one likes to burden him or herself with an empty luggage throughout half or three quarter trip and also not like to buy an expensive luggage, which may become storage problem at home. Thus there is need to provide a solution for the same.

The luggage made from metal or plastic utilizes maximum space in the home, as they are not foldable adding storage problem. Further, molded rigid plastic luggage looks strong but its brittleness increases with time. Furthermore, It tends to loose its alignment of corners and hinges and difficult to store.

The luggage made from fabrics is known as soft luggage. However, generally soft luggage is built around a rigid frame, hence it is not strong enough to carry weights and cannot withstand compression force which may result in damaging of the contents and not stackable.

U.S. Pat. No. 4,318,505 claims a disposable suitcase to solve abovementioned problems, which is made from a single sheet of material such as corrugated fiberboard and preferably scored to be in a tightly locked box configuration. However, this disposable suitcase claimed in this Patent is a handbag and cannot take maximum load. Further, it is s also difficult to handle, as it is not stackable.

SUMMARY OF THE INVENTION

It is an object of the present invention to provide a foldable and/or disposable luggage, which is easy to handle, store and stack.

Further object of the present invention is to overcome shortcomings of the background.

The present invention provides a foldable and/or disposable luggage having wheels adapted detachably.

In one aspect, the present invention provides a foldable and/or disposable luggage, comprising: two main panels, namely top main panel and a bottom main panel, and a plurality of side panels of the luggage formed by folding atleast one scored and cut flat blank; plurality of holes provided on atleast one of the panels of the flat blank; atleast one extended panel; and a ply having wheels aligning with the holes of the panel; wherein said ply is adapted detachably between extended panel and the panel having holes while folding the blank to form a luggage with wheels.

According to one embodiment of the present invention, the extended panel extends from one of the side panels and preferably inwardly foldable.

According to the present invention at least two wheels are adapted on the ply. Advantageously, four wheels are adapted on the ply.

According to the present invention, the holes are provided on one of the side panels to adapt the ply. Preferably, holes are provided on the side panel having extended panel therewith. Alternatively, holes can be provided on the bottom main panel.

According to one embodiment of the present invention, the extended panel has flap bending in reverse direction enabling to hold the side panels in vertical position with respect to the main panels.

According to the present invention, the ply is made of material such as wood, plastic, paper or metal etc.

According to the present invention, the luggage has at least three sides and preferably comprises four sides.

According to the present invention, the blank is made of corrugated board comprising one or more ply/layer. The corrugated board is made of disposable and/or foldable material such as paper including various combination of paper including printed, plain, colored, coated, laminated, Kraft, White paper, Duplex paper, triplex paper, water proof paper, foil laminated, film laminated, treated paper, etc.

In another aspect, the present invention provides a foldable and/or disposable luggage comprising two main panels, namely top main panel and a bottom main panel, and a plurality of side panels of the luggage formed by folding atleast one scored and cut flat blank and atleast one extended panel extending from one of the side panels wherein plurality of holes or perforations for forming holes are provided on atleast one of the panels of the flat blank to adapt a ply having wheels detachably between extended panel and the panel having holes while folding the blank to form a luggage with wheels.

According one embodiment of the present invention, the holes or perforations for forming holes are provided on one of the side panels to adapt wheels of the ply and preferably the holes or perforations are provided on the side panel having extended panel therewith.

According another embodiment of the present invention, the holes are provided on the bottom main panel to adapt wheels of the ply.

BRIEF DESCRIPTION OF THE DRAWINGS

To illustrate the invention, a preferred embodiment thereof will now be described with reference to the accompanying drawings (which in no way restrict the scope of the invention and are for the purpose of illustration only) in which:

FIG. 2A shows a blank as shown in FIG. 1;

FIGS. 2B, 2C, 2D shows preparation views according to the present invention;

FIGS. 2E, 2F and 2G shows closing operation of the foldable and/or disposable luggage;

FIG. 2H shows a closed foldable and/or disposable luggage;

DETAILED DESCRIPTION OF THE INVENTION

The present invention provides a luggage, which is mainly foldable and/or disposable. In preferable terms, the present invention provides said foldable and/or disposable luggage made of corrugated board having wheels adapted detachably to the luggage, which makes the luggage easy to handle, store and stackable.

In general terms, the foldable and/or disposable luggage comprises two main panels, namely top main panel and a bottom main panel, and a plurality of side panels of the luggage formed by atleast one scored die-cut flat blank, an extended panel, and a ply having wheels aligning with the holes of the said panel.

Preferably extended panel extends from one of the side panels bending inwardly.

Generally, the holes or perforations are provided on bottom side panel. Alternatively, extended panel may be provided bending outwardly with holes to adapt the ply with holes.

According to the present invention, the ply after aligning with caster wheels with the holes is sandwiched between the panel having holes and the extended panel while folding the flat blank to form the foldable and/or disposable luggage with the wheels. Hence luggage of the present invention is easy to carry or handle. The sandwiching process held the ply tightly between the extended panel and the panel having holes.

According to one embodiment of the present invention, the extended panel has flap bending in reverse direction enabling to hold the side panels in vertical position with respect to the main panels.

According to the present invention, the luggage has at least three sides panels and preferably comprises four side panels along with top and bottom main panel.

According to the present invention, the ply having wheels is made of material such as wood, plastic, paper or metal etc.

The die cut blank of the foldable and/or disposable luggage is preferably made of the corrugated board of one or more layer/ply, which is made of disposable and/or foldable material such as paper including printed, plain, colored, coated, laminated, Kraft, White paper, Duplex paper, triplex paper, water proof paper, foil laminated, film laminated, treated paper etc. It is well know that corrugated boards have high compression strength therefore, the luggage of the present invention has high compression strength.

According to the present invention, the foldable and/or disposable luggage can be formed from a single scored and cut blank or can comprise of two halves, namely top and bottom, made from the scored cut blank wherein top of the luggage fits over the bottom to form a luggage with wheels.

Figure 1:
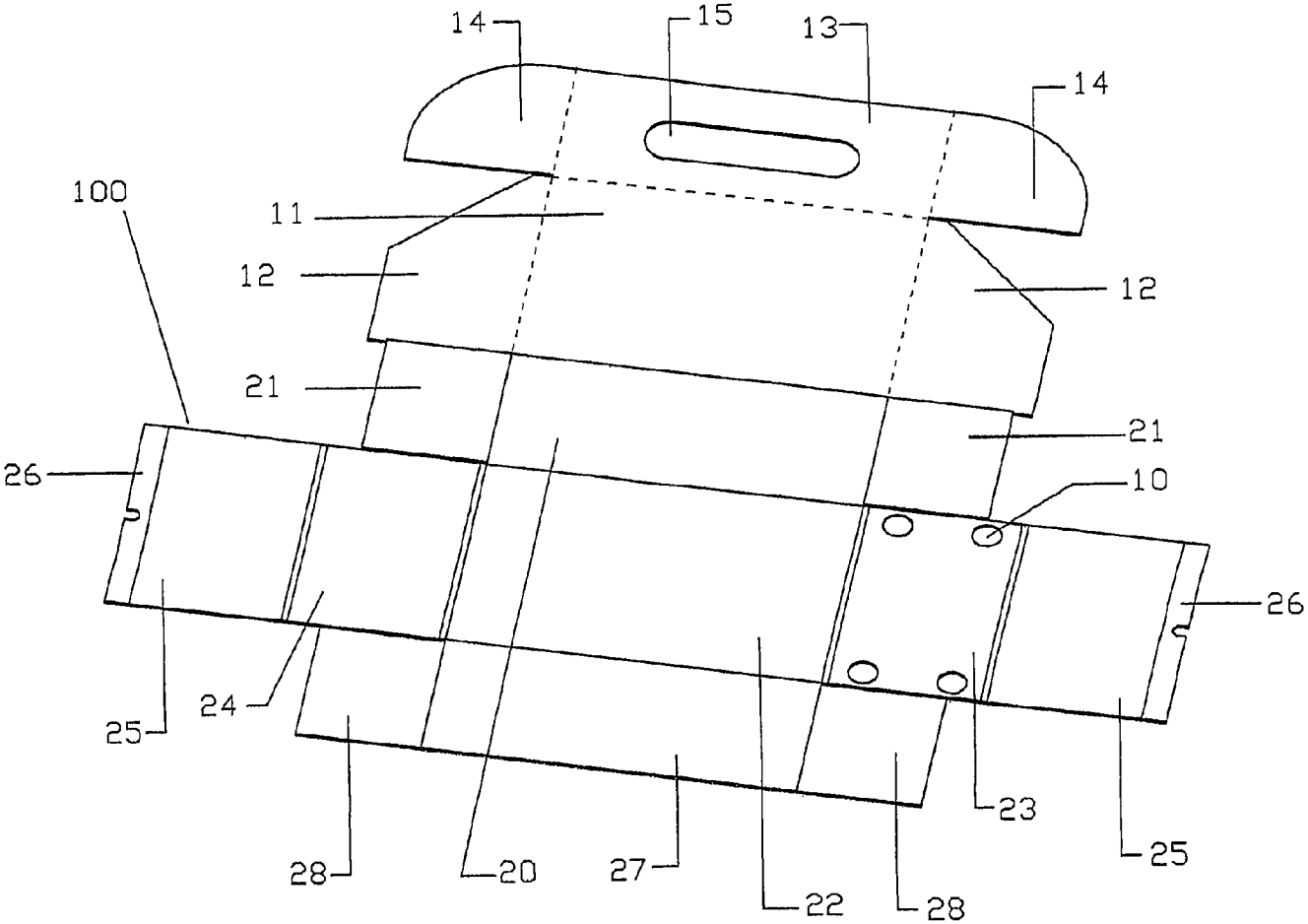
FIG. 1 shows a flat die-cut blank of a foldable and/or disposable luggage made from a single blank according to one embodiment of the present invention.

A foldable and/or disposable luggage (200) of rectangular shape made from a single scored and cut blank shown in FIGS. 1 and 2B is shown in FIG. 2H.

As shown in FIGS. 1 and 2B, the single blank (100) is cut and scored to form a top main panel, bottom main panel and four side panels of the luggage (200) along with extensions to form a fordable luggage. A bottom side panel (20) of the luggage has tabs (21) extending from its narrow edge (not shown). The top main panel (11) and the bottom main panel (22) of the luggage extend oppositely from the longitudinal edges (not shown) of the bottom side panel (20) wherein the top main panel (11) has a pair of orthogonally foldable panels (12) extending therefrom and the bottom main panel (22) has opposed side panels (23, 24) with extended panels (25) therefrom. Each extended panel (25) has a flap (26) bending in reverse direction according to the present invention. As shown in the FIG. 1 and FIG. 2B, one (23) of the side panels has four holes (10) near the corner (not shown) matching with caster wheels (31) adapted on a ply (3) (shown in FIG. 2C). The top side panel (27) of the luggage extends from the longitudinal edge of the bottom panel (22). The top side panel (27) has tabs (28) folding upwardly and a handle (51). A locking panel (13) extends from the upper edge of the top main panel (11) and has wings (14) foldable orthogonally for locking the luggage when folded. A slot (15) aligning with the handle (51) of top side panel (27) is provided on the locking panel (13) for allowing overlapping of the locking panel (13) over the top side panel (27).

Alternatively, the single flat blank to form the luggage according to the present invention can be formed by fixing two or more cut and scored flat blanks. FIG. 2A shows two blanks (100A, 100B) as per one of the embodiment in which one (100A) of the blanks has a base (20A) with the top main panel and other extension such as tabs, locking panel with wings, and other blank (100B) has a base (20B) including the bottom main panel and extensions such as the side panels with extended panels and the top side panel with tabs. The base (20A) is fixed over the base (20B) to form the single blank of the luggage with a bottom side panel (20). The fixing of the bases adds further sturdiness to the bottom of the luggage. Such variations can be used to increase durability of the luggage of the present invention. Assembly of the structure from the single flat blank (100) to form foldable and/or disposable luggage (200) by folding is shown through FIG. 2C-2H. To form a luggage according to the present invention from the single flat blank (100), the bottom side panel (20) along with the top main panel (11) and the top side panel (27) are bent upwardly at their scored lines and then the tabs (21, 28) of the bottom side panel (20) and the top side panel (27) as shown in FIG. 1C are bent inwardly. As the tabs (21, 28) of the bottom panel and top panel (27) are bent inwardly at the scored lines, the side panels (23, 24) are bent upwardly and then extended panels (25) are bent inwardly. The flaps (26) provided on the outer edges (not shown) of the extended panel (25) are simultaneously bent in reverse direction as shown in FIG. 2D, to form a foldable and/or disposable luggage (200). The flaps (26) held the side panels (23, 24) in vertical position. According to the present invention, the ply (3) with wheels (31) is inserted between the extended panel (25) and the bottom side panel (23) by passing the wheels (31) through the holes (10) provided on the side panel (23). The ply (3) is to be inserted before bending bottom side panel (23) upwardly or before bending the extended panel (25) inwardly. FIG. 2E shows the luggage of the present invention in open state for filling the items. To close the foldable and/or disposable luggage, the user has to move the tabs (12) of the top main panel (11) upwardly and the top main panel (11) downwardly and then for locking the luggage, user has to bend the locking panel downwardly along with the wings (14) of the locking panel (12) to bend inwardly as shown in FIG. 1F and then require to insert the wings (14) in the gap (not shown) formed between the side panels (23, 24) and the extended panels (25) as shown in FIG. 2G thereby closing the foldable and/or disposable luggage (200) as shown in FIG. 2H.

Figure 6:
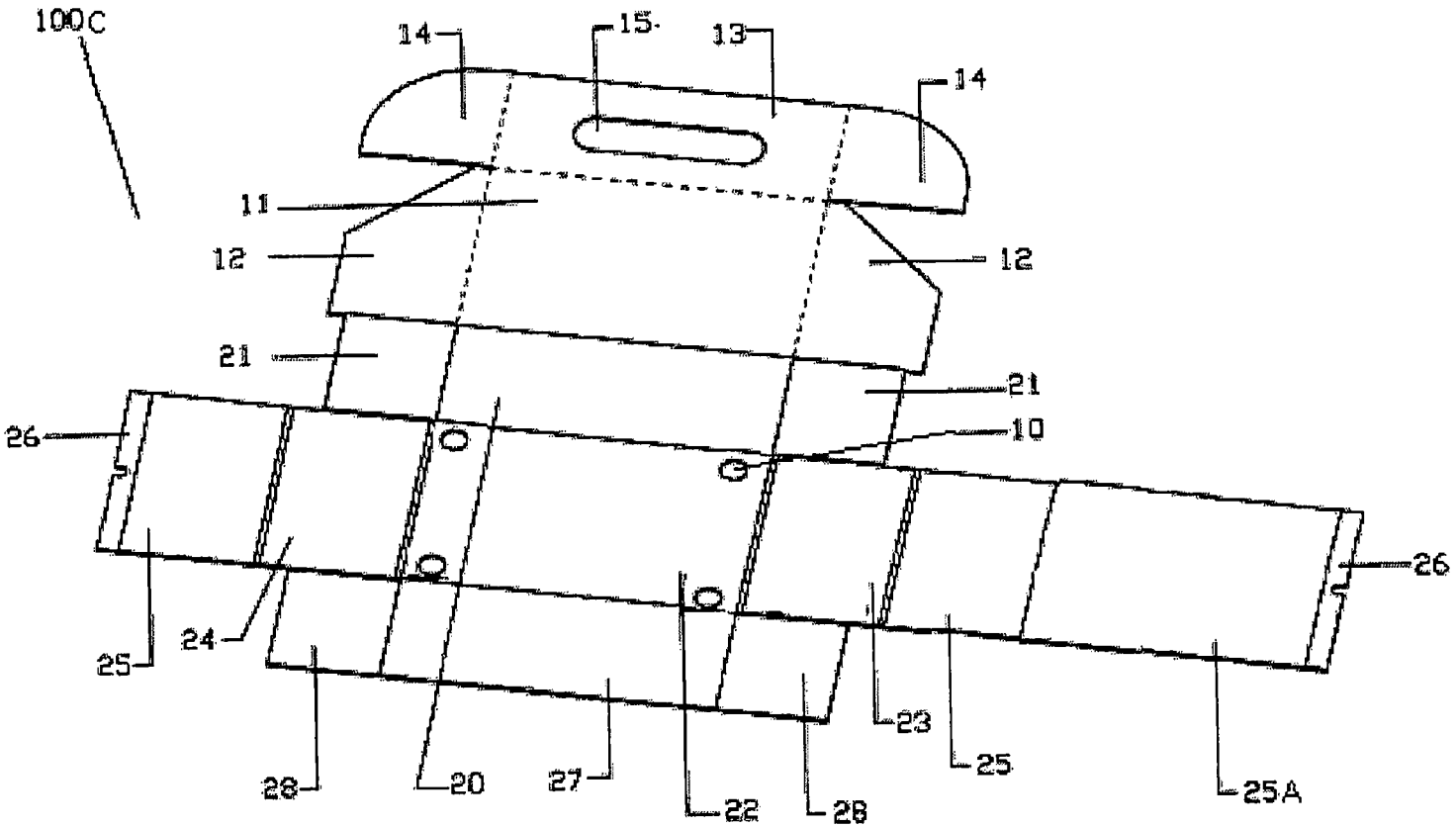
FIG. 6 shows a flat die-cut blank of one of the alternate embodiments of a foldable and/or disposable luggage according to the present invention.

According to the present invention, alternatively, holes can be provided on the bottom main panel or bottom side panel to adapt the ply with wheels. In case of the bottom main panel, one or both side panel may comprise one more extended panel bending in reverse direction before the flaps to adapt the ply with wheels removably and in case of bottom side panel, the one or both extended panels may comprise extended panel in the form of tabs to adapt the ply with wheels on the bottom side panel. FIG. 6 shows a flat pack blank (100C) having holes (10A) provided in the bottom main panel (22) to adapt a ply (not shown) with wheels and the two extended side panels (25, 25A) to adapt the ply with wheels removably between the bottom main panel (22) and the extended panel (25A). Such various arrangements can be done to provide to form a foldable and/or disposable luggage according to the present invention from a single blank.

Figure 3:
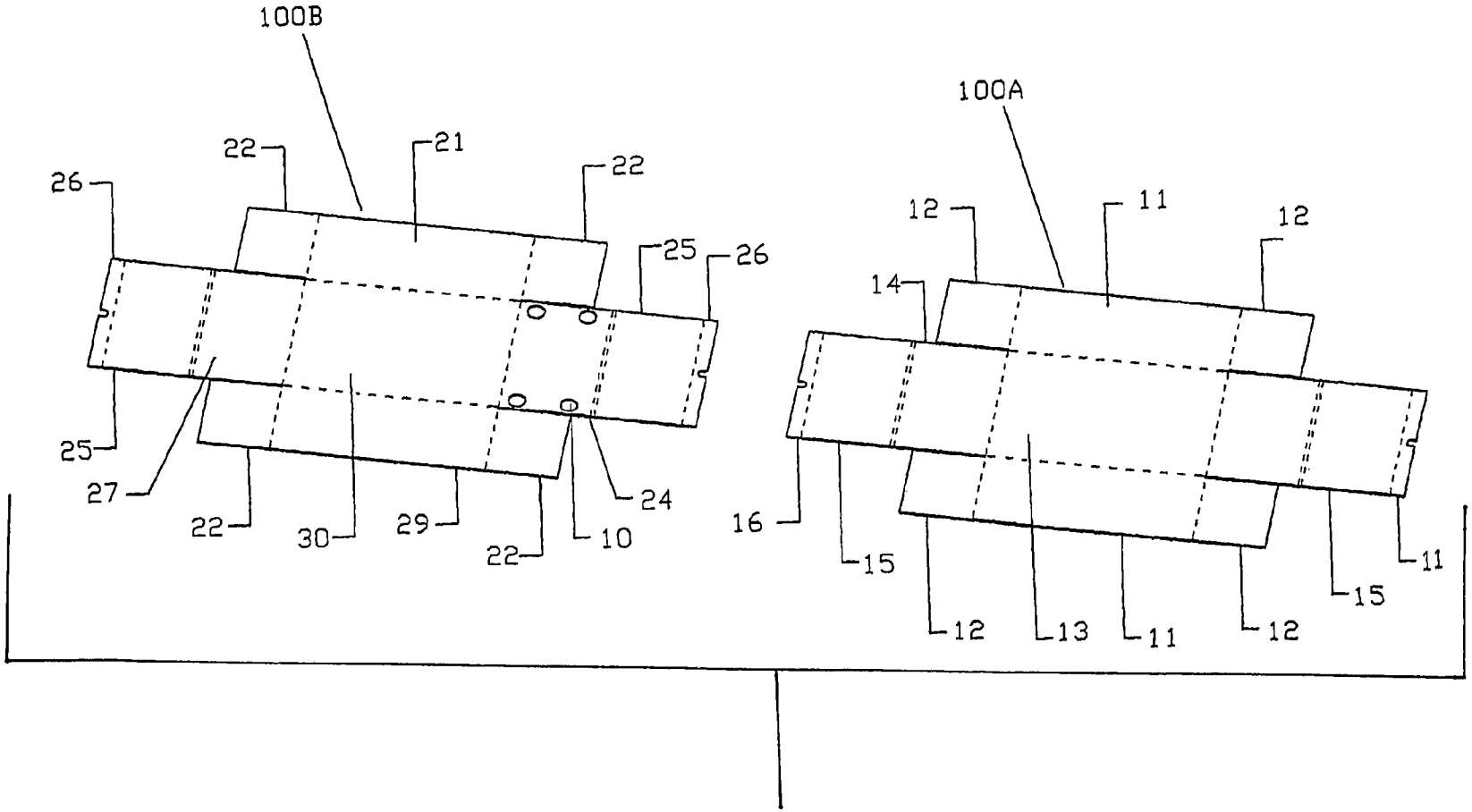
FIG. 3 shows two flat die-cut blanks to form top and bottom of the luggage according to another embodiment of the invention.
Figure 4:
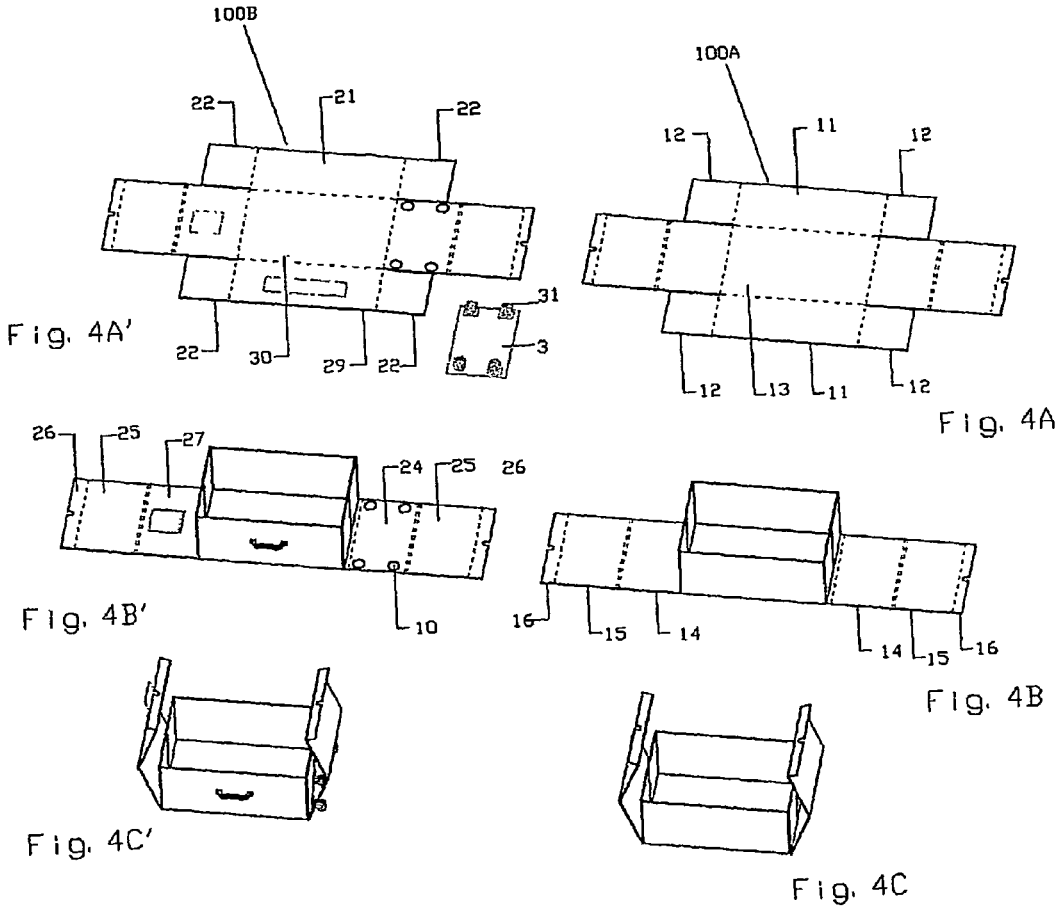
FIGS. 4A and 4A' shows the flat blank as shown in FIG. 3.
FIGS. 4B and 4B', and FIGS. 4C and 4C' show a preparation of the top and bottom according the present invention.
FIGS. 4D and 4D' show a top and bottom of the foldable and/or disposable luggage respectively according to the present invention.
FIG. 4E shows the top adapting over the bottom to form a foldable and/or disposable luggage.
FIG. 4F shows a foldable and/or disposable luggage according to present invention.

Referring FIG. 3 and FIG. 4A of FIG. 4, which show two blanks (100A and 100B) to form two halves namely top and bottom of the foldable and/or disposable luggage (200) according to the present invention. Each flat blank (100A & 100B) comprises a main panel (13 & 30) and four side panels (11, 14 & 21, 29, 27, 27) wherein one (14 & 24, 27) of the opposed pairs of side panels has extended panels (15 & 25) and other opposed pair (11 & 21, 29) of side panels has orthogonally foldable tabs (12 & 22). According to the present invention, one of the panels of these two blanks has perforations to form holes or holes for adapting a ply having wheels to form a foldable and/or disposable luggage with wheels. As shown in FIGS. 3 and 4A' which is a flat blank to form a top of the luggage, the side panel (24) has holes (10) near the corners to adapt the wheels of the ply. Alternatively, holes can be provided on the main panel of the bottom of the luggage with one more extended panel provided on the side panel(s) of the bottom. Referring to FIG. 3A, the side panel (27) opposite the side panel (24) has a handle (61). Also one of the longitudinal side panels (21, 29) of the top has a handle (51).

Assembly of the structure from two blanks having scored lines for folding or bending to form two halves namely top and bottom of the foldable and/or disposable luggage from the two blank scored blanks (100A, 100B) shown in FIG. 3 is shown in FIG. 4 through 4A, 4A' to 4D, 4D' respectively. The longitudinal side panels (11, 17 & 21, 27) of the blanks (100A, 100B) are bent upwardly respectively along with bending the tabs (12 & 22,28) inwardly as shown in FIGS. 4B and 4B'. As the tabs (12 & 22, 28, of the longitudinal panels are bent inwardly, the side panels (14 & 24, 27) on the transverse side are bent upwardly as shown in FIGS. 4C and 4C' respectively and then extended panels (15 & 25) are bent inwardly. The flaps (16 & 26) provided on the outer edges of the extended panels (15 & 25) are simultaneously bent in reverse direction. The flaps (16 & 26) held the all side panels (11, 14 & 21, 29, 24, 27) in vertical position forming top (60) and bottom (50) of the foldable and/or disposable luggage (200) as shown in FIGS. 4D and 4D' respectively. According to the present invention, the ply (3) having wheels (31) is inserted between the tabs (22) of the longitudinal side panels (21, 29) and the side panel (24) having holes (10). The ply (3) is inserted by passing the wheels through the holes (10) provided on the side panel (24) before bending side panel (24) upwardly as shown in FIG. 4B'. FIGS. 4D and 4D' shows the luggage of the present invention in open state for filling the items. After filing the items, the top (60) can be adapted over the bottom (50) to form a luggage as shown in FIG. 4F. The top and bottom of the luggage can be fastened together with locking means such as belt, strap etc.

By reversing the above-stated procedures as shown in FIGS. 2 and 4 for a luggage which are formed from single blank and two blanks respectively, the luggage can be easily disassembled into a flat blank(s) and a ply with wheels for storage thereby the present invention solves problem of storage and also easy to handle in dissembled form also.

As the luggage of the present invention can be generally made of the corrugated board, it can withstand high compression strength and can be used for air-traveling or other such traveling where luggage are stacked without hesitation.

As the luggage can be made from disposable and recyclable material, it can be eco-friendly.

Figure 7:
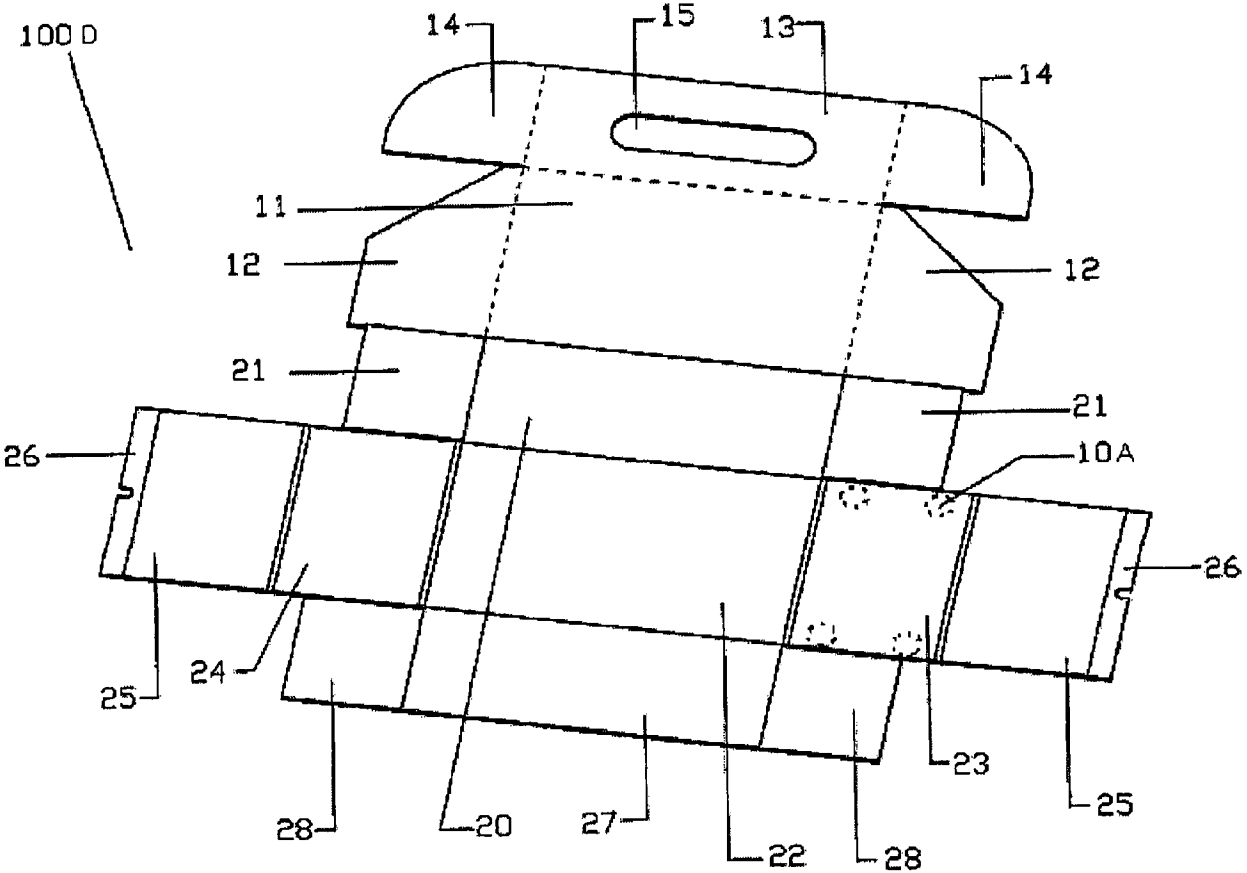
FIG. 7 shows a flat die-cut blank having perforations to form holes according to an embodiment of the present invention.

The blanks of the luggage according to the present invention having perforations on one of the side panel to form holes for adapting the wheels of the ply can be formed, as the ply can be adapted removably or detachably. This allows the further reduction in the cost when the user is interested to buy the foldable and/or disposable luggage again. Referring FIG. 7 shows a blank (100D) of the foldable and/or disposable luggage (200) of FIG. 2G wherein said blank (100D) has perforations (10A) to form holes (10) as shown in FIG. 2B.

Figure 5:
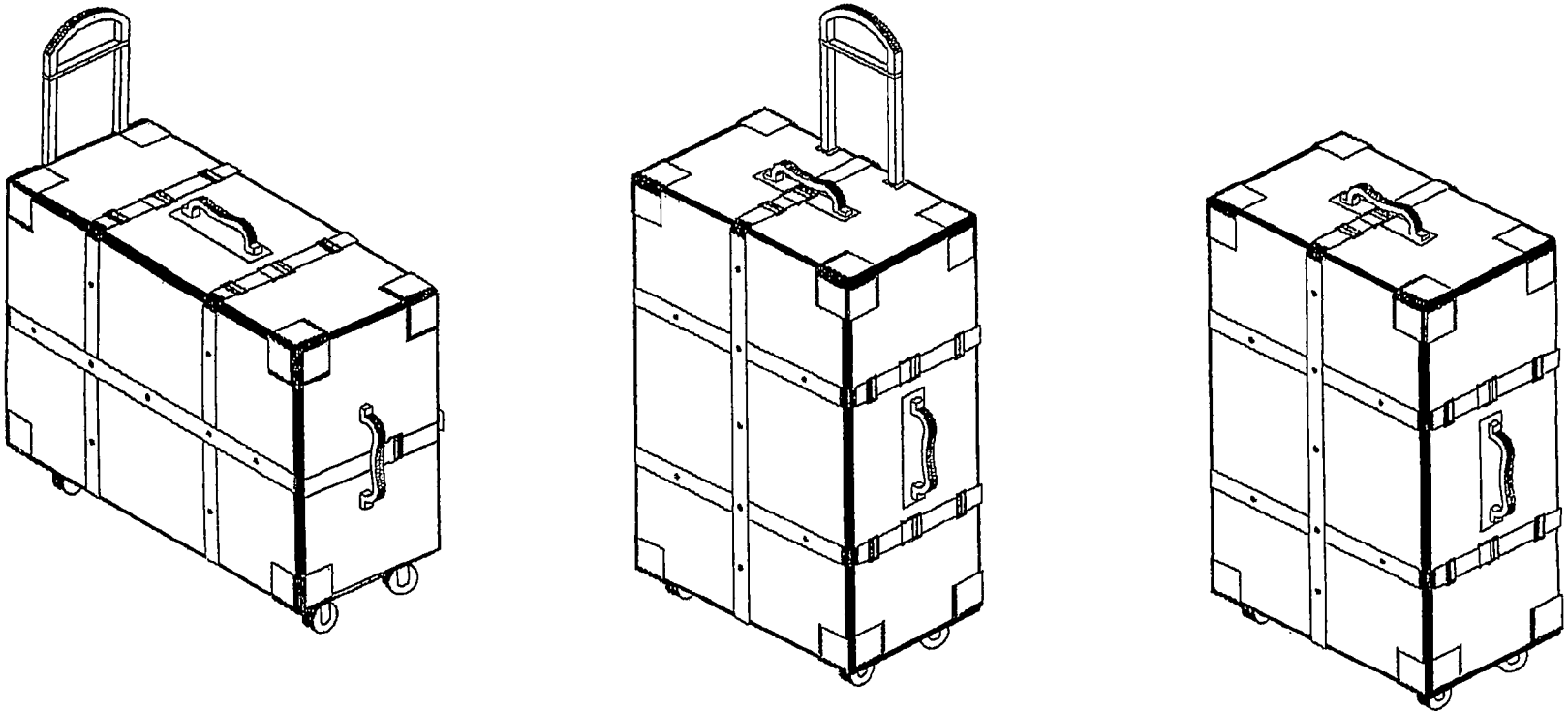
FIG. 5 shows a foldable and/or disposable luggage of the present invention with various accessories adapted on it.

As shown in FIG. 5, the various known accessories such as enforcement belts, corners, handles, wheels, locks, carts, pullers, legs, stands, pads, rivets, buckles, clamps, bumpers, padding or the like can be adapted at appropriate places fixedly or detachably on the foldable and/or disposable luggage.

The present invention is not limited to the die cuts of the flat blank as shown in the FIGS. 1 & 3 and the shape of the luggage in the FIGS. 2 & 4. Various arrangements or rearrangements in the blanks and shape can be done to form the luggage of the present invention from single blank or more blanks of shape such as such as triangular, cubical, polygonal etc. The present invention lies in providing a foldable and/or luggage having an arrangement to adapt the wheels detachably and not in the blank as shown in the Figures. The Figures are for the reference and not limiting the invention.

The word 'luggage' used in this specification is not limited to traveler suitcase, baggage or other means to carry cloths or other small goods of the traveler, but also includes containers, boxes, cases etc. Further, the luggage of the present invention can be used as cabinet, drawer, container etc. in the house, offices etc.

While the present invention has been described with respect to certain preferred embodiments, it will be apparent to those skilled in the art that various changes and modification may be made without departing from the scope of the invention as defined in the following claims.

The invention claimed is:

1. A foldable and/or disposable luggage, comprising: two main panels, namely top main panel and a bottom main panel, and a plurality of side panels of the luggage formed by folding at least one scored flat blank; plurality of holes provided on at least one of the panels of the flat blank; at least one extended panel extending from one of the side panels of the at least one blank; and a ply having wheels aligning with the holes of the panel, wherein said ply is adapted detachably between the extended panel and the panel having holes while folding the flat blank to form a luggage with wheels.

2. The foldable and/or disposable luggage as claimed in claim 1 wherein the extended panel is preferably inwardly foldable.

3. The foldable and/or disposable luggage as claimed in claim 1 wherein the holes are provided on one of the side panels to adapt wheels of the ply.

4. The foldable and/or disposable luggage as claimed in claim 1 wherein the holes are provided on the side panel having extended panel therewith.

5. The foldable and/or disposable luggage as claimed in claim 1 wherein the holes are provided on the bottom main panel to adapt wheels of the ply.

6. The foldable and/or disposable luggage as claimed in claim 1 wherein said luggage has at least three side panels.

7. The foldable and/or disposable luggage as claimed in claim 1 wherein said luggage has preferably four side panels.

8. The foldable and/or disposable luggage as claimed in claim 1 wherein the luggage is formed from one single scored flat blank.

9. The foldable and/or disposable luggage as claimed in claim 1 wherein said luggage made of two cut and scored blanks forming top and bottom of the luggage.

10. The foldable and/or disposable luggage as claimed in claim 1 wherein extended panel has flap bending in reverse direction enabling to hold the side panels in vertical position with respect to the main panels.

11. The foldable and/or disposable luggage as claimed in claim 1 wherein said ply comprises at least two caster wheels.

12. The foldable and/or disposable luggage as claimed in claim 1 wherein said ply comprises four caster wheels.

13. The foldable and/or disposable luggage as claimed in claim 1 wherein the ply is made of a material such as wood, plastic, paper, metal etc.

14. The foldable and/or disposable luggage as claimed in claim 1 wherein the blank is made of corrugated board comprising one or more layer/ply.

15. The foldable and/or disposable luggage as claimed in claim 14 wherein said corrugated board is made of a disposable or foldable material including paper selected from printed, plain, colored, coated, laminated, Kraft, white, duplex, triplex, foil laminated, film laminated, or treated, etc.

16. A foldable and/or disposable luggage, comprising: two main panels, namely top main panel and a bottom main panel, and a plurality of side panels of the luggage formed by folding at least one scored flat blank and at least one extended panel extending from one of the side panels wherein plurality of holes or perforations for forming holes are provided on at least one of the panels of the flat blank to adapt a ply having wheels detachably between extended panel and the panel having holes while folding the blank to form a luggage with wheels.

17. The foldable and/or disposable luggage as claimed in claim 16 wherein the holes or perforations are provided on one of the side panels to adapt wheels of the ply and preferably the holes or perforations are provided on the side panel having extended panel therewith.

18. The foldable and/or disposable luggage as claimed in claim 16 wherein the holes are provided on the bottom main panel to adapt wheels of the ply.

* * * * *